US010945322B1

(12) United States Patent
Xiong

(10) Patent No.: US 10,945,322 B1
(45) Date of Patent: Mar. 9, 2021

(54) LIGHTING CIRCUIT AND METHOD FOR NEGATIVE FEEDBACK CONTROL RECOVERY IN OVERLOAD CONDITIONS

(71) Applicant: UNIVERSAL LIGHTING TECHNOLOGIES, INC., Madison, AL (US)

(72) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/804,093

(22) Filed: Feb. 28, 2020

Related U.S. Application Data

(60) Provisional application No. 62/832,355, filed on Apr. 11, 2019.

(51) Int. Cl.
*H05B 45/305* (2020.01)
*H05B 45/382* (2020.01)
*H05B 45/50* (2020.01)

(52) U.S. Cl.
CPC ..... *H05B 45/50* (2020.01); *H05B 45/305* (2020.01); *H05B 45/382* (2020.01)

(58) Field of Classification Search
CPC ..... H05B 45/12; H05B 45/14; H05B 45/305; H05B 45/385; H05B 45/39; H05B 45/50; H05B 45/382
USPC ..... 315/224, 225, 226, 247, 291, 307
See application file for complete search history.

(56) References Cited

U.S. PATENT DOCUMENTS 4,349,752 A 9/1982 Forte
5,696,431 A 12/1997 Giannopoulos et al.
5,864,472 A 1/1999 Peterson
7,595,969 B2 9/2009 Oba
8,057,652 B2 11/2011 Routbort et al.
9,112,415 B2 * 8/2015 Grakist ..... H05B 41/2856
9,237,613 B1 * 1/2016 Xiong ..... H05B 45/10
9,837,913 B1 * 12/2017 Xiong ..... H05B 45/10
10,098,194 B1 10/2018 Xiong
10,243,473 B1 3/2019 Xiong et al.
10,476,399 B1 11/2019 Xiong
2004/0160794 A1 8/2004 Lin
(Continued)

OTHER PUBLICATIONS

International Rectifier, IRS27951S, IRS27952(4)S, Aug. 27, 2015, pp. 10-19 (2015).

*Primary Examiner* — Henry Luong
(74) *Attorney, Agent, or Firm* — Patterson Intellectual Property Law, P.C.; Gary L. Montle; Alex H. Huffstutter

(57) ABSTRACT

A resonant power converter (e.g., LED driver) comprises a switching power stage having an operating frequency to produce output current through an LED load. A current sensor is coupled to the LED load, and a negative control means regulates the operating frequency based on error signals from the sensed current relative to a reference value. A reference control circuit controls the error signal (e.g., by manipulating the reference value) responsive to the error signal exceeding a reference error signal for regaining negative feedback control. The reference control circuit includes a quick discharge circuit for quickly reducing the error signal when it exceeds the reference error signal, and a slow charge circuit for slowly increasing the error signal when it is reduced, for example giving the LED load time to warm up in transition from a cold operational state to a normal operational state.

18 Claims, 7 Drawing Sheets

(56) References Cited

U.S. PATENT DOCUMENTS

| | | | | |
|---|---|---|---|---|
| 2010/0277957 | A1 | 11/2010 | Chueh et al. | |
| 2012/0153858 | A1 | 6/2012 | Melanson et al. | |
| 2013/0099788 | A1 | 4/2013 | Xu et al. | |
| 2013/0271021 | A1 | 10/2013 | Elferich | |
| 2014/0091720 | A1* | 4/2014 | Brinlee ..... | H05B 47/10 315/186 |
| 2014/0167640 | A1 | 6/2014 | Knoedgen | |
| 2014/0252981 | A1 | 9/2014 | Xie et al. | |
| 2015/0103562 | A1 | 4/2015 | Yeh et al. | |
| 2015/0257222 | A1 | 9/2015 | Siessegger et al. | |
| 2016/0014858 | A1 | 1/2016 | Ramabhadran et al. | |
| 2016/0057825 | A1 | 2/2016 | Hu et al. | |
| 2016/0073457 | A1 | 3/2016 | Nakajo | |
| 2016/0190945 | A1 | 6/2016 | Liu et al. | |
| 2016/0276936 | A1 | 9/2016 | Gritti | |
| 2017/0093296 | A1 | 3/2017 | Chen | |
| 2017/0179831 | A1 | 6/2017 | Yu et al. | |
| 2017/0187298 | A1 | 6/2017 | Lin | |
| 2017/0222565 | A1 | 8/2017 | Sonobe | |
| 2018/0153020 | A1 | 5/2018 | Sun et al. | |
| 2018/0234019 | A1 | 8/2018 | Chen | |
| 2018/0262118 | A1 | 9/2018 | Ouyang | |

* cited by examiner

LIGHTING CIRCUIT AND METHOD FOR NEGATIVE FEEDBACK CONTROL RECOVERY IN OVERLOAD CONDITIONS

CROSS-REFERENCES TO RELATED APPLICATIONS

This application claims benefit under 35 USC. § 119(e) of U.S. Provisional Patent Application No. 62/832,355, filed Apr. 11, 2019, entitled "A Method to Regain Negative Feedback Control from Power Clamping Mode in Over-Load Condition," and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present disclosure relates generally to power supplies that provide a DC voltage to a load, such as, for example, light-emitting diodes. More particularly, the present disclosure relates to an apparatus and method for controlling and maintaining negative feedback of a power supply when running into an over-load condition.

Constant-power tunable LED drivers are very popular in the lighting market because of their flexibility to drive different LED loads at different current levels. A single constant-power driver, for example, a 220-Watt constant-power LED driver can drive any load from 2-Amps at 110-Volts to 1.4-Amps at 157-Volts. The current provided by the driver is tunable using a programming tool.

One such constant-power tunable driver which may be used to drive an LED load is a half-bridge resonant type DC-DC converter. A half-bridge resonant type DC-DC converter is a very good candidate for driving an LED load because it has a high efficiency and a wide load range. The typical half-bridge resonant type DC-DC converter includes a feedback loop which utilizes negative feedback control to control an output current. The half-bridge resonant type DC-DC converter can operate on both sides of the converter's resonant frequency. However, negative feedback control only works when the operating frequency is above the resonant frequency. Under certain circumstances, such as an overload condition, the operating frequency may drop below the resonant frequency, lose negative feedback control, and get stuck at a minimum frequency. The half-bridge resonant type DC-DC converter has no way to automatically pull the operating frequency back up above the resonant frequency in order to reestablish negative feedback control.

BRIEF SUMMARY

Accordingly, a need exists for methods and associated circuitry which is configured to regain negative feedback control when a power converter gets stuck in an overload condition, e.g., when the operating frequency gets stuck at a minimum frequency below the resonant frequency.

One embodiment of a power converter as disclosed herein to address the above-referenced problem comprises first and second switching elements coupled across a direct current (DC) power source, and a resonant circuit coupled between an isolation transformer primary winding and an output node between the first and second switching elements. A current sensing circuit is coupled between an output load and a secondary winding of the isolation transformer, and provides a sensor output signal representative of an output current through the load. A feedback circuit generates an error signal corresponding to a difference between the sensor output signal and a reference signal. A controller is provided which comprises a frequency control input terminal, and is configured to generate drive signals to the first and second switching elements at a determined operating frequency. A frequency control circuit is coupled between the feedback circuit and the frequency control input terminal of the controller and, responsive to the error signal, determines the operating frequency of the controller with respect to defined minimum and maximum frequencies. A current reference control circuit is provided to control the error signal of the feedback circuit when the error signal is greater than a reference error signal of the current reference control circuit.

In one exemplary further aspect of the above-referenced embodiment, the current reference control circuit may include a slow charge path and a quick discharge path in parallel between the output terminal of the feedback circuit and an integrator capacitor of the current reference control circuit. The quick discharge path may be configured to discharge the integrator capacitor at a first rate when the error signal is greater than the reference error signal, wherein the slow charge path is configured to charge the integrator capacitor at a second rate slower than the first rate when the error signal is less than the reference error signal.

For example, the slow charge path may include a first resistor having a first resistance, and the quick discharge path may include a diode in series with a second resistor having a second resistance smaller than the first resistance.

In another exemplary aspect of the above-referenced embodiment, the integrator capacitor may be coupled between an inverting input terminal of an operational amplifier and an output terminal of the operational amplifier, and the slow charge path and the quick discharge path may be coupled to the inverting input terminal of the operational amplifier.

In another exemplary aspect of the above-referenced embodiment, the feedback circuit may include a buffer resistor coupled between the reference signal and the first input terminal, and a buffer capacitor coupled between the first input terminal and a secondary side ground reference. The current reference control circuit may further include an output control diode coupled in series with an output control resistor between the output terminal of the operational amplifier and the first input terminal of the feedback circuit.

In another exemplary aspect of the above-referenced embodiment, the operational amplifier may be configured to generate a reference control signal at the output terminal, and voltage across the buffer capacitor may be controlled by the reference control signal when the reference control signal is lower than the reference signal.

In another exemplary aspect of the above-referenced embodiment, voltage across the buffer capacitor may be controlled by the reference signal when the reference control signal is greater than the reference signal.

In another exemplary aspect of the above-referenced embodiment, the output control diode may be reverse biased when the reference control signal is greater than the reference signal.

In another exemplary aspect of the above-referenced embodiment, the reference error signal may be received at a non-inverting input terminal of an operational amplifier of the current reference control circuit.

In another exemplary aspect of the above-referenced embodiment, the feedback circuit may include a buffer resistor coupled between the reference signal and the first input terminal, and a buffer capacitor coupled between the first input terminal and a secondary side ground reference. The current reference control circuit may be configured to control a voltage across the buffer capacitor when a reference control signal generated by the current reference control circuit is less than the reference signal.

In another exemplary embodiment, an LED driver as disclosed herein comprises a DC-DC converter with a plurality of switching elements configured to produce an output voltage across first and second output terminals and an output current through an LED load coupled thereto, based on a DC input and an operating frequency. A current sensor is coupled in series with the LED load. A first circuit is provided for regulating the operating frequency based on an error signal derived at least in part from output signals from the current sensor relative to a reference value. A second circuit is provided for controlling the error signal in response to the error signal exceeding a reference error signal for regaining negative feedback control of the first circuit.

In one exemplary aspect of this embodiment, the second circuit may manipulate the reference value in order to temporarily affect the error signal.

In another exemplary aspect of this embodiment, the second circuit may include a quick discharge means for quickly reducing the error signal in response to the error signal exceeding the reference error signal, and a slow charge means slowly increasing the error signal in response the error signal being reduced.

In another exemplary aspect of this embodiment, the slow charge means may give the LED load time to warm up in order to transition from a cold operational state to a normal operational state.

DETAILED DESCRIPTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The following detailed description of embodiments of the present disclosure refers to one or more drawings. Each drawing is provided by way of explanation of the present disclosure and is not a limitation. Those skilled in the art will understand that various modifications and variations can be made to the teachings of the present disclosure without departing from the scope of the disclosure. For instance, features illustrated or described as part of one embodiment can be used with another embodiment to yield a still further embodiment.

The present disclosure is intended to cover such modifications and variations as come within the scope of the appended claims and their equivalents. Other objects, features, and aspects of the present disclosure are disclosed in the following detailed description. One of ordinary skill in the art will understand that the present discussion is a description of exemplary embodiments only and is not intended as limiting the broader aspects of the present disclosure.

Figure 1:
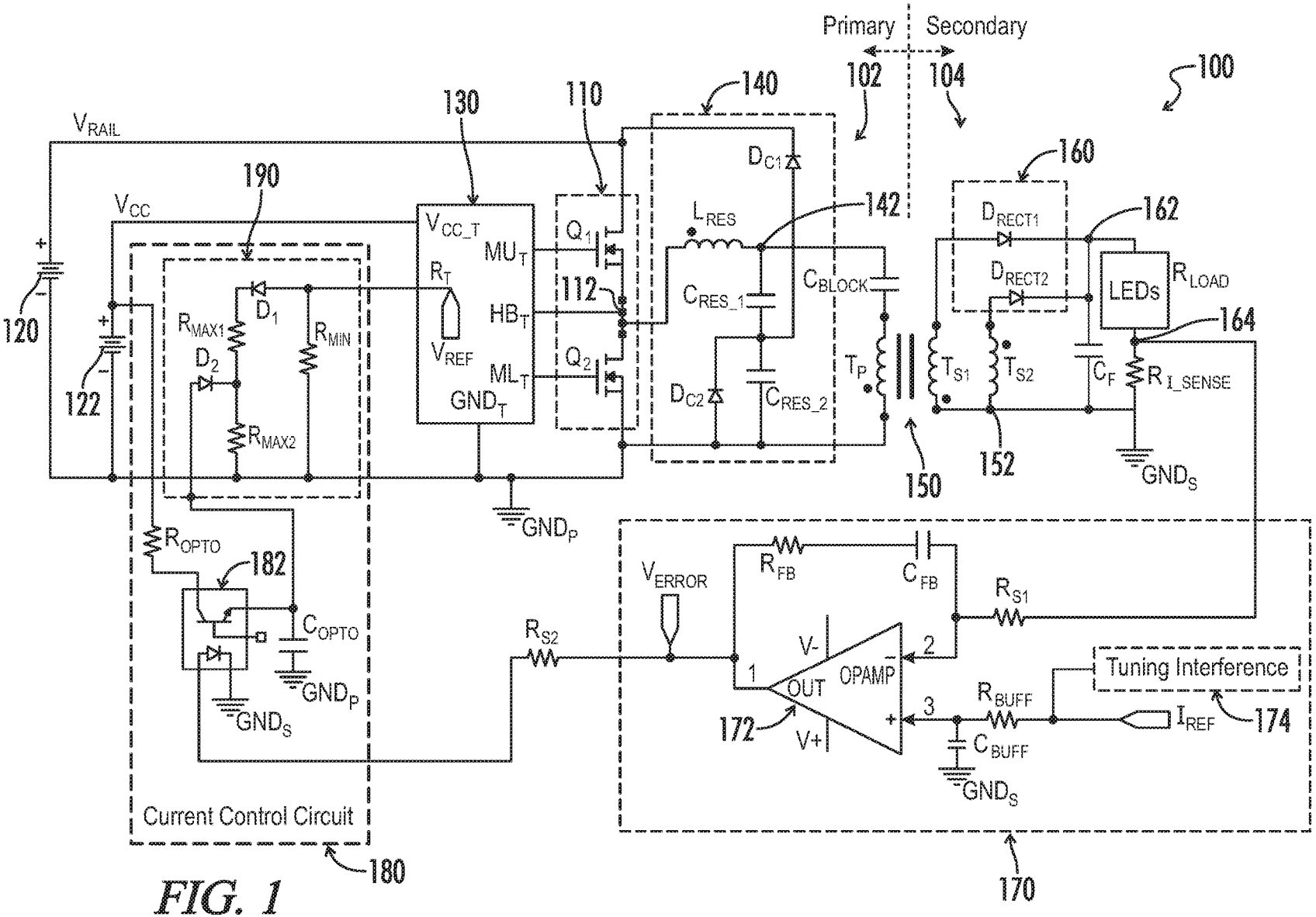
FIG. 1 illustrates a half-bridge resonant type DC-to-DC converter.

Referring to FIG. 1, a half-bridge resonant type DC-DC converter 100 is provided. The half-bridge resonant type DC-DC converter 100 may also be referred to herein as a partially clamped resonant converter 100 or a tunable constant power LED driver.

The converter 100 includes a primary circuit 102 and a secondary circuit 104, which are electrically isolated as described below. The converter includes a first switch $Q_1$ and a second switch $Q_2$ in a half-bridge switching circuit 110. The switches may be, for example, metal oxide semiconductor field effect transistors (MOSFETs) or bipolar junction transistors (BJTs). In the illustrated embodiment, the two switches are n-channel MOSFETs. The half-bridge switching circuit is connected between a DC input bus $V_{RAIL}$ and a primary circuit ground reference $GND_P$. The DC input bus $V_{RAIL}$ may be considered as a first voltage rail; and the primary circuit ground reference may be considered as a second voltage rail. The drain of the first switch is connected to the DC input bus. The source of the first switch is connected to the drain of the second switch at a common switched node 112 of the half-bridge switching circuit. The source of the second switch is connected to the primary circuit ground reference.

In the illustrated embodiment, the voltage on the DC input bus 120 is provided by a first DC voltage source 120. In the illustrated embodiment, the first DC voltage source is illustrated as a battery; however, it should be understood that the voltage on the DC input bus may be provided by other sources, such as, for example, a power factor correction (PFC) stage, the DC output of a bridge rectifier, or the like, which are supplied from an AC source (not shown). The battery is representative of a variety of voltage sources that provide a substantially constant voltage on the DC input bus.

Each of the first switch $Q_1$ and the second switch $Q_2$ has a respective control input terminal. In the illustrated embodiment incorporating MOSFETs, the control input terminals are the gates of the two transistors. The control input terminals are driven by a self-oscillating half-bridge gate driver integrated circuit (IC) 130, which may also be referred to as a switch controller. In an illustrated embodiment, the driver IC (switch controller) 130 may be, for example, an NCP1392B high-voltage half-bridge driver with inbuilt oscillator, which is commercially available from ON Semiconductor Company of Phoenix, Ariz. The driver IC 130 is powered by a second DC voltage source 122 via an input terminal $V_{CC_T}$ of the driver IC 130. In FIG. 1, the second DC voltage source is illustrated as a battery that provides a voltage $V_{CC}$; however, it should be understood that the second DC voltage source may also be derived from an AC source.

The driver IC (switch controller) 130 is responsive to a timing resistance connected to a timing terminal $R_T$ to alternately apply an upper drive voltage on an upper drive terminal $MU_T$ and apply a lower drive voltage to a lower drive terminal $ML_T$. The upper output drive voltage is applied to the control input terminal of the first switch $Q_1$. The lower output drive voltage is applied to the control input terminal of the second switch $Q_2$. When the resistance applied to the timing terminal $R_T$ of the driver IC 130 increases, the current flowing out of the timing terminal decreases, which causes the frequency of the drive voltages applied to the two switches to decrease. When the resistance applied to the timing terminal $R_T$ of the driver IC 130 decreases, the current flowing out of the timing terminal increases, which causes the frequency of the drive voltages to increase. A ground terminal $GND_T$ of the driver IC 130 is coupled to the primary circuit ground $GND_P$. The driver IC 130 may include other terminals that are not shown in FIG. 1.

The common switched node 112 of the half-bridge switching circuit 110 is connected to a half bridge connection terminal $HB_T$ of the driver IC 130. The first and second switches Q1, Q2 provide a high frequency AC voltage input to a resonant circuit 140. The resonant circuit 140 may also be referred to herein as a partially clamped resonant circuit 140. The common switched node 112 is also connected to a first terminal of a resonant inductor $L_{RES}$ of the resonant circuit 140. A second terminal of the resonant inductor $L_{RES}$ is connected to a first terminal of a first resonant capacitor $C_{RES_1}$ at an output node 142 in the resonant circuit 140. A second terminal of the first resonant capacitor $C_{RES_1}$ is connected to a first terminal of a second resonant capacitor $C_{RES_2}$. A second terminal of the second resonant capacitor $C_{RES_2}$ is connected to the primary circuit ground reference $GND_P$. The voltage on the second resonant capacitor $C_{RES_2}$ is clamped by a first clamping diode $D_{C1}$ and a second clamping diode $D_{C2}$. The cathode of the first clamping diode $D_{C1}$ is coupled to the DC input bus $V_{RAIL}$. The anode of the first clamping diode $D_{C1}$ is coupled to the second terminal of the resonant inductor $L_{RES}$. The cathode of the second clamping diode $D_{C2}$ is coupled to the second terminal of the resonant inductor $L_{RES}$. The anode of the second clamping diode $D_{C2}$ is coupled to the primary circuit ground reference $GND_P$. The first resonant capacitor $C_{RES_1}$ is specifically designed so that the resonant circuit 140 will always have soft-switching within a certain frequency range (i.e., between a minimum frequency $f_{min}$ and a maximum frequency $f_{max}$).

The output node 142 of the resonant circuit 140 is connected to a first terminal of a DC blocking capacitor $C_{BLOCK}$. A second terminal of the DC blocking capacitor $C_B$ is connected to a first terminal of a primary winding $T_P$ of an output isolation transformer 150. A second terminal of the primary winding $T_P$ of the output isolation transformer 150 is connected to the primary circuit ground reference $GND_P$. The foregoing components on the primary circuit 102 of the half-bridge switching circuit 110 operate as a DC to AC inverter to produce an AC voltage across the primary winding $T_P$ of the output isolation transformer 150.

The output isolation transformer 150 includes a first secondary winding $T_{S1}$ and a second secondary winding $T_{S2}$. The two secondary windings $T_{S1}$, $T_{S2}$ are electrically isolated from the primary winding $T_P$. As illustrated, the primary winding $T_P$ is electrically part of the primary circuit 102, and the secondary windings $T_{S1}$, $T_{S2}$ are electrically part of the secondary circuit 104. The two secondary windings $T_{S1}$, $T_{S2}$ have respective first terminals, which are connected at a center tap 152. Respective second terminals of the first and second secondary windings $T_{S1}$, $T_{S2}$ are connected to input terminals of a half-bridge rectifier 160. The half-bridge rectifier 160 comprises a first rectifier diode $D_{RECT1}$ and a second rectifier diode $D_{RECT2}$. The second terminal of the first secondary winding $T_{S1}$ is connected to the anode of the first rectifier diode $D_{RECT1}$. The second terminal of the second secondary winding $T_{S2}$ is connected to the anode of the second rectifier diode $D_{RECT2}$. The cathodes of the two rectifier diodes are connected together at an output node 162 of the half-bridge rectifier 160. The center tap 152 of the first and second secondary windings $T_{S1}$, $T_{S2}$ is connected to a secondary circuit ground reference $GND_S$. In other embodiments having a single, non-center-tapped secondary winding (not shown), the half-bridge rectifier with the two rectifier diodes may be replaced with a full-bridge rectifier with four rectifier diodes.

The output node 162 of the half-bridge rectifier 160 is connected to a first terminal of an output filter capacitor $C_F$. A second terminal of the output filter capacitor is connected to the secondary circuit ground reference $GND_S$. An output voltage ($V_{OUT}$) is developed across the output filter capacitor at the output node 162 of the half-bridge rectifier 160. The output node 162 of the half-bridge rectifier 160 is also connected to a first terminal of a load $R_{LOAD}$, which may comprise, for example, one or more light-emitting didoes (LEDs) that emit light when sufficient current passes through the LEDs. A second terminal of the load is connected to a current sensing node 164 and to the first terminal of a current sensing resistor $R_{1_SENSE}$. A second terminal of the current sensing resistor $R_{1_SENSE}$ is connected to the secondary circuit ground reference $GND_S$. When current flows through the load $R_{LOAD}$, the same current flows through the current sensing resistor $R_{1_SENSE}$. Accordingly, a voltage develops on the current sensing node 164 that has a magnitude with respect to the secondary circuit ground reference $GND_S$ that is proportional to the current flowing through the load $R_{LOAD}$. In one embodiment, the current sensing resistor $R_{1_SENSE}$ has a resistance of, for example, 0.1 ohm such that the effect of the resistance of the current sensing resistor $R_{1_SENSE}$ on the load current is insignificant.

When the driver IC 130 operates to apply alternating drive voltages to the first switch Q1 and the second switch Q2, an AC voltage develops across the first and second resonant capacitors $C_{RES1}$, $C_{RES2}$. The voltage across the first and second resonant capacitors $C_{RES1}$, $C_{RES2}$ may include a DC component; however, the DC blocking capacitor $C_{BLOCK}$ transfers only the AC component of the energy stored in the first and second resonant capacitors $C_{RES1}$, $C_{RES2}$ to the primary winding $T_P$ of the output isolation transformer 150. The transferred energy is magnetically coupled from the primary winding $T_P$ to the electrically isolated first and second secondary windings $T_{S1}$, $T_{S2}$. The first and second rectifier diodes $D_{RECT1}$, $D_{RECT2}$ in the half-bridge rectifier 160 rectify the AC energy from the first and second secondary windings $T_{S1}$, $T_{S2}$ into DC energy, which is provided on the output node 162. The DC energy is stored in the output filter capacitor $C_F$ at a voltage determined by the amount of stored energy. Current from the output filter capacitor $C_F$ is provided to the load $R_{LOAD}$ at a magnitude determined by the voltage on the half-bridge rectifier output node and the resistance of the load.

Because the intensity of the light emitted by the LEDs in the load $R_{LOAD}$ is dependent on the magnitude of the current flowing through the LEDs, the current is controlled closely. The current sensing resistor $R_{1_SENSE}$ senses the current $I_{LOAD}$ going through the load $R_{LOAD}$ and develops a sensor voltage $V_{1_SENSE}$ on the current sensing node 164 proportional to the load current $I_{LOAD}$. The sensor voltage $V_{1_SENSE}$ may also be referred to herein as a sensor output signal. The sensor voltage $V_{1_SENSE}$ representing the sensed current $I_{SENSE}$ is fed back to a feedback circuit 170 to provide current regulation.

The feedback circuit 170 is configured to regulate the output current $I_{LOAD}$ through the load $R_{LOAD}$ at a reference current $I_{REF}$. The feedback circuit 170 may also be referred to herein as a proportional integral (PI) current control loop 170 or a PI negative feedback control loop 170. The reference current $I_{REF}$ may also be referred to herein as a reference signal $I_{REF}$. The output current $I_{LOAD}$ can also be referred to herein as a load current $I_{LOAD}$. The feedback circuit 170 includes an operational amplifier (OPAMP) 172 having an inverting (−) input terminal, having a non-inverting (+) input terminal, and having an output (OUT) on an output terminal. The current sensing node 164 is connected to the inverting input of the OPAMP 172 via a first series resistor $R_{S1}$. A feedback resistor $R_{FB}$ and a feedback capacitor $C_{FB}$ are connected in series between the output terminal of the OPAMP 172 and the inverting input. The feedback resistor $R_{FB}$ may also be referred to herein as a gain control resistor. The feedback capacitor $C_{FB}$ may also be referred to herein as an integration capacitor. The first series resistor $R_{S1}$ and the feedback resistor $R_{FB}$ determine the proportional gain of the feedback circuit 170. The first series resistor $R_{S1}$ and the feedback capacitor $C_{FB}$ determine the crossover frequency of the feedback circuit 170.

The reference current $I_{REF}$ is connected to the non-inverting input of the OPAMP 172 via a buffer resistor $R_{BUFF}$ and a buffer capacitor $C_{BUFF}$. The buffer resistor $R_{BUFF}$ and the buffer capacitor $C_{BUFF}$ are used to buffer the reference current $I_{REF}$. The buffer resistor $R_{BUFF}$ is connected between a reference current node 174 where at the reference current $I_{REF}$ is received and the non-inverting input of the OPAMP 172. The buffer capacitor $C_{BUFF}$ is connected between the non-inverting input of the OPAMP 172 and the secondary circuit ground reference $GND_S$. The reference current $I_{REF}$ is transmitted through the buffer resistor and is used to charge up a voltage $V_{C_BUFF}$ across the buffer capacitor $C_{BUFF}$, which is sensed or received by the non-inverting input of the OPAMP 172. The voltage $V_{C_BUFF}$ may also be referred to herein as a current control voltage $V_{C_BUFF}$.

The magnitude of the reference current $I_{REF}$ is selected to produce a desired load current $I_{LOAD}$ through the load $R_{LOAD}$. The reference current $I_{REF}$ may be a fixed reference current to provide a constant load current. A tuning interface 174, such as, for example, a dimmer, can be provided for adjusting the magnitude of the reference current $I_{REF}$ whenever is necessary to drive a specific load. If the reference current $I_{REF}$ changes to a new magnitude, the load current $I_{LOAD}$ is adjusted and maintained constant relative to the new magnitude. The OPAMP 172 is responsive to a difference in the magnitudes of the reference current $I_{REF}$ and the sensor voltage $V_{1_SENSE}$ at the current sensing node 164 to generate an error signal $V_{ERROR}$. The error signal $V_{ERROR}$ is used to control the operating frequency $f_{op}$ of the driver IC 130 as described below. The OPAMP 172 may also be considered as a comparator because the OPAMP 172 compares the magnitudes of the two input signals and generates an output signal having a magnitude responsive to a difference between the magnitudes of the two input signals.

During operation of the OPAMP 172, when the output current $I_{LOAD}$ is lower than the reference current $I_{REF}$ the error signal $V_{ERROR}$ at the output terminal will increase.

When the output current $I_{LOAD}$ is greater than the reference current $I_{REF}$ the error signal $V_{ERROR}$ at the output terminal will decrease. The error signal $V_{ERROR}$ is fed to a current control circuit 180 to achieve close loop frequency control in order to maintain a constant output current when the load $R_{LOAD}$ changes.

The output terminal of the OPAMP 172 is connected to the input stage of an optocoupler 182 of the current control circuit 180 via a second series resistor $R_{S2}$. The optocoupler 182 may also be referred to herein as an opto isolator, or an optical isolator. The input stage of the optocoupler 182 has an internal light generation device (e.g., an LED) coupled to the input of the optocoupler. The light generation device is responsive to a voltage (e.g., the error signal $V_{ERROR}$) applied to the input stage to generate light. The applied voltage is referenced to the secondary circuit ground reference $GND_S$ to which the light generation stage is connected. The generated light is propagated internally to a light-responsive base of a phototransistor in an output stage within the same component. The phototransistor has an emitter and a collector. The emitter is connected to the primary circuit ground reference $GND_P$ through an optocoupler capacitor $C_{OPTO}$. The impedance of the phototransistor between the collector and the emitter in the output stage of the optocoupler is responsive to the light generated by the input stage. Thus, the impedance of the output stage is responsive to the voltage applied to the input stage. In the illustrated embodiment, increasing the voltage applied to the input stage decreases the impedance of the output stage, and decreasing the voltage applied to the input stage increases the impedance of the output stage. The optocoupler electrically isolates the secondary circuit voltages and the secondary circuit ground reference $GND_S$ in the secondary circuit 104 from the primary circuit voltages and the primary circuit ground reference $GND_P$ in the primary circuit 102.

In the example shown, the collector of the phototransistor in the output stage of the optocoupler 182 is connected to the second DC voltage source 122 through an optocoupler resistor $R_{OPTO}$.

The emitter of the phototransistor of the output stage of the optocoupler 182 is further connected to an input node of a frequency control block 190 of the current control circuit 180. The frequency control block 190 includes a minimum frequency resistor $R_{MIN}$ coupled between the timing terminal $R_T$ of the driver IC 130 and the primary circuit ground reference $GND_P$. The frequency control block 190 further includes a first diode $D_1$, second diode $D_2$, a first maximum frequency resistor $R_{MAX1}$, and a second maximum frequency resistor $R_{MAX2}$. An anode of the first diode $D_1$ is coupled to the timing terminal $R_T$ of the driver IC 130. The first and second maximum frequency resistors $R_{MAX1}$, $R_{MAX2}$ are coupled in series between a cathode of the first diode $D_1$ and the primary circuit ground reference $GND_P$. A node defined between the first and second maximum frequency resistors is coupled to a cathode of the second diode $D_2$ of the frequency control block. An anode of the second diode $D_2$ is coupled to the input node of the frequency control block.

The current control circuit 180 receives the error signal $V_{ERROR}$ from the feedback circuit 170 and adjusts the operating frequency $f_{op}$ of the driver IC 130. The frequency control driver IC is directly proportional to the current that flows out the timing terminal $R_T$ of the driver IC 130, which is internally connected to a reference voltage $V_{REF}$. The operating frequency $f_{op}$ follows the equation:

$$f_{op} = I_{R_T} \cdot 250 \text{ (KHz/mA)} = \frac{V_{REF}}{R_{TOTAL}} \cdot 250 \text{ (KHz/mA)} \tag{1}$$

$R_{TOTAL}$ is the total resistance connected to the timing terminal Rt.

Before the feedback circuit 170 starts working, the error signal $V_{ERROR}$ is zero. Accordingly, the second diode $D_2$ doesn't conduct any current and the emitter of the optocoupler 182 is open. As a result, there is no voltage across the optocoupler capacitor $C_{OPTO}$ which causes the second diode $D_2$ to be negatively biased and thus not conduct any current. This is when the maximum frequency $f_{max}$ of the driver IC 130 happens.

If the error voltage $V_{ERROR}$ is too high, it will drive too much current through the second diode $D_2$. This will in turn saturate the emitter of the optocoupler 182 and will force the emitter resistance to be very close to zero. As a result, there will be a large voltage across the second maximum frequency resistor $R_{MAX2}$. If the voltage across the second maximum frequency resistor $R_{MAX2}$ is greater than the reference voltage $V_{REF}$, for example $V_{REF}$ may equal 3.5 volts, then the first diode $D_1$ will stop conducting current. This is when the minimum frequency $f_{min}$ of the driver IC 130 happens.

The minimum operating frequency $f_{min}$ when the reference voltage $V_{REF}$ is equal to 3.5 volts can be defined based on the discussion above as follows:

$$f_{min} = \frac{3.5}{R_{min}} \cdot 250 \text{ (KHz/mA)} \tag{2}$$

The maximum operating frequency $f_{max}$ when the reference voltage $V_{REF}$ is equal to 3.5 volts can be defined based on the discussion above as follows:

$$f_{max} = \frac{3.5}{\frac{R_{min} \cdot (R_1 + R_2)}{R_{min} + (R_1 + R_2)}} \cdot 250 \text{ (KHz/mA)} \tag{3}$$

Figure 2:
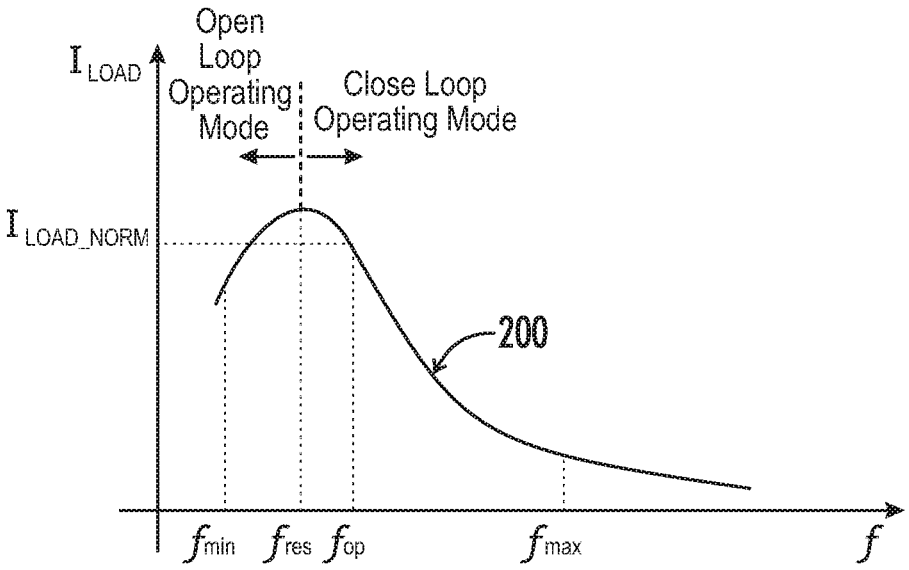
FIG. 2 illustrates a graph of the current gain curve of the output current versus frequency of the half-bridge resonant type DC-DC converter of FIG. 1.

Referring to FIG. 2, a current gain curve graph 200 of the output current $I_{LOAD}$ through the load $R_{LOAD}$ versus frequency f is provided for the converter 100. As mentioned above, the resonant circuit 140 will function at an operating frequency $f_{op}$ on both sides of the resonant frequency $f_{res}$ (i.e., between the minimum frequency $f_{min}$ and the maximum frequency $f_{max}$). When the operating frequency $f_{op}$ is between the resonant frequency $f_{res}$ and the maximum operating frequency $f_{max}$, the output current $I_{LOAD}$ increases when the operating frequency $f_{op}$ decreases. This is associated with a close loop operating mode or normal operation of the converter 100 wherein close-loop negative feedback control through the feedback circuit 170 functions properly. The close loop operating mode may also be referred to herein as a close loop mode, a normal mode, or a normal operating mode. A normal load current $I_{LOAD_NORM}$ corresponds to the operating frequency being between the minimum frequency $f_{min}$ and the maximum frequency $f_{max}$.

When the operating frequency $f_{op}$ is between the resonant frequency $f_{res}$ and the minimum operating frequency $f_{min}$, the output current $I_{LOAD}$ decreases when the operating frequency $f_{op}$ decreases. This is associated with an open loop operating mode. The open loop operating mode may also be referred to herein as an open loop mode, a frequency-clamp operating mode, or a frequency-clamp mode. In this mode, close-loop negative feedback control through the feedback circuit 170 is lost.

When operating the converter 100 in the close loop operating mode (i.e., associated with normal conditions), the operating frequency $f_{op}$ is greater than the resonant frequency $f_{res}$ in order to maintain close-loop negative feedback control through the feedback circuit 170. The following control sequence relationships of the converter 100 are true only in the close loop mode. When the output current $I_{LOAD}$ is less than the reference current $I_{REF}$, the error signal $V_{ERROR}$ increases and thus supplies more current to the input stage of the optocoupler 182, the impedance of the output stage of the optocoupler 182 decreases, the voltage across the second maximum frequency resistor $R_{MAX2}$ increases, the current at the timing terminal $R_T$ increases, the operating frequency $f_{op}$ decreases, and finally the load current $I_{LOAD}$ increases. When the output current $I_{LOAD}$ is greater than the reference current $I_{REF}$, the error signal $V_{ERROR}$ decreases and thus supplies less current to the input stage of the optocoupler 182, the impedance of the output stage of the optocoupler 182 increases, the voltage across the second maximum frequency resistor $R_{MAX2}$ decreases, the current at the timing terminal $R_T$ decreases, the operating frequency $f_{op}$ increases, and finally the load current $I_{LOAD}$ decreases.

As shown in FIG. 2, when in the close loop operating mode, a decrease in the operating frequency $f_{op}$ will cause the load current $I_{LOAD}$ to increase. Negative feedback control works properly in the close loop operating mode. As further shown in FIG. 2, when in the open loop operating mode, a decrease in the operating frequency $f_{op}$ will cause the load current $I_{LOAD}$ to decrease. Accordingly, negative feedback control will not work properly when the operating frequency $f_{op}$ is less than the resonant frequency $f_{res}$.

If by chance the operating frequency $f_{op}$ is pushed below the resonant frequency $f_{res}$ (i.e., open loop operating mode) and the output current $I_{LOAD}$ is less than the reference current $I_{REF}$, the feedback circuit 170 will continue to push the operating frequency down to the minimum frequency $f_{min}$ in an attempt to increase the load current $I_{LOAD}$. However, because the operating frequency $f_{op}$ is less than the resonant frequency $f_{res}$, a decrease to the operating frequency $f_{op}$ will cause the load current $I_{LOAD}$ to also decrease. Accordingly, the operating frequency $f_{op}$ will get stuck at the minimum frequency $f_{min}$ forever, unless the reference current $I_{REF}$ is changed, for example, by a dimming controller. This situation is associated with a loss of close-loop negative feedback control.

Figure 3A:
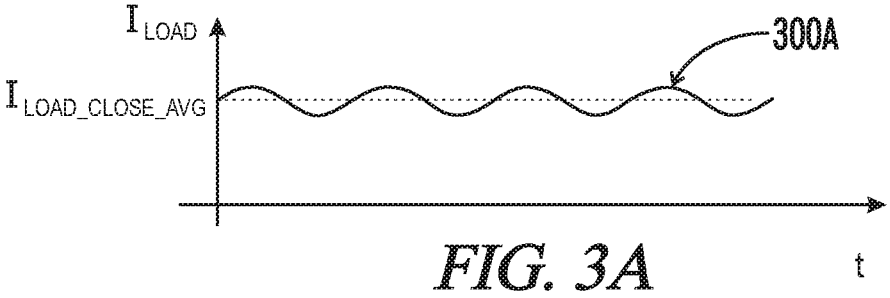
FIG. 3A illustrates a graph of a waveform of the average output current versus time when the half-bridge resonant type DC-DC converter of FIG. 1 operates in a closed loop mode.
Figure 3B:
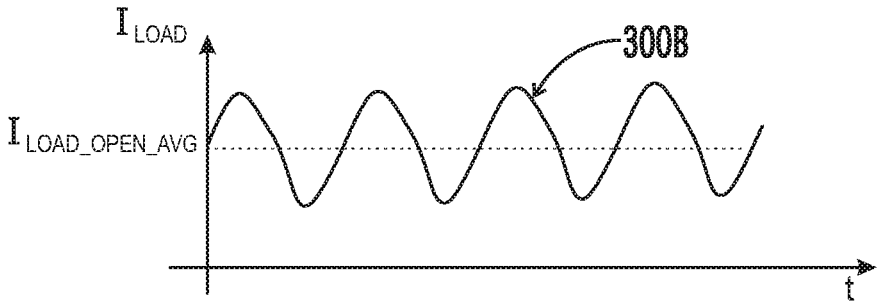
FIG. 3B illustrates a graph of a waveform of the average output current versus time when the half-bridge resonant type DC-DC converter of FIG. 1 operates in an open loop mode.

Referring to FIGS. 3A and 3B, close mode and open mode waveform graphs 300A, 300B associated with the output current $I_{LOAD}$ through the load $R_{LOAD}$ in the close loop operating mode and the open loop operating mode are provided, respectively. The waveform graph 300A is associated with the close mode average output current $I_{LOAD_CLOSE_AVG}$ for the converter 100. The waveform graph 300B is associated with the open mode average output current $I_{LOAD_OPEN_AVG}$ for the converter 100. The converter 100 will continue to operate safely when the operating frequency $f_{op}$ is equal to the minimum frequency $f_{min}$ without close-loop negative feedback control. In this situation, the ripple of the open mode average output current $I_{LOAD_OPEN_AVG}$, as shown in FIG. 3B, will be very large as compared to the ripple of the close mode average output current $I_{LOAD_CLOSE_AVG}$ associated with working close-loop negative feedback control, as shown in FIG. 3A. The large ripple may cause the load current $I_{LOAD}$ to be greater than the rated current associated with the load $R_{LOAD}$, thus potentially and likely damaging the load $R_{LOAD}$.

One instance in which the loss of close-loop negative feedback control could happen is when the DC-to-DC converter attempts to provide power to a cold LED load. The cold LED load could have a cold load voltage $V_{LOAD_COLD}$ that is 30% greater than a normal load voltage $V_{LOAD_NORM}$.

Figure 4:
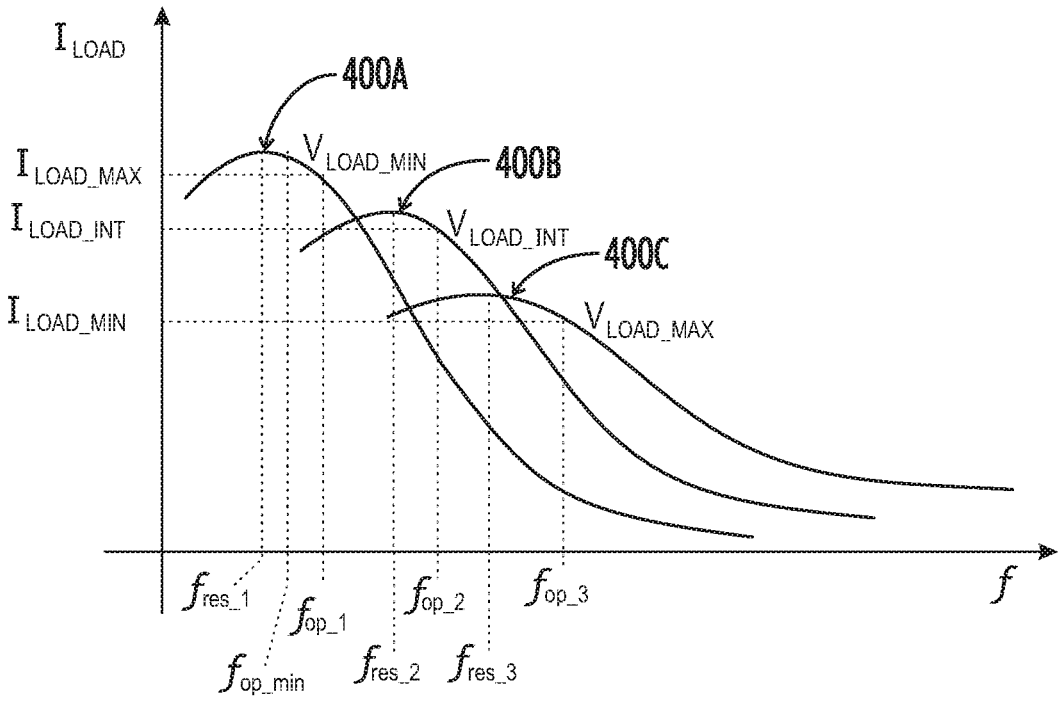
FIG. 4 illustrates a graph of the current gain curves of the output current versus frequency of the half-bridge resonant type DC-DC converter of FIG. 1 when the load operates under three different load conditions (e.g., a minimum load condition, an intermediate load condition, and a maximum load condition).

The converter 100 is a constant power driver. This means that the output current $I_{LOAD}$ can be programmed for different loads. For different loads, the current gain curve is different, as shown in FIG. 4. In other words, when a voltage $V_{LOAD}$ of the load $R_{LOAD}$ changes, the associated current gain curve changes.

As can best be seen in FIG. 4, current gain curve graphs 400A, 400B, 400C of the output current $I_{LOAD}$ versus frequency f are shown for three different loads including a minimum load, an intermedia load, and a maximum load, respectively, of the converter 100. The current gain curve graph 400A is associated with the load $R_{LOAD}$ operating at a minimum output voltage $V_{LOAD_MIN}$. The current gain curve graph 400C is associated with the load $R_{LOAD}$ operating at a maximum output voltage $V_{LOAD_MAX}$. And the current gain curve graph 400B is associated with the load $R_{LOAD}$ operating at an intermediate output voltage $V_{LOAD_INT}$ between the minimum output voltage $V_{LOAD_MIN}$ and the maximum output voltage $V_{LOAD_MAX}$.

The maximum gain of each curve is different. When the load is at a minimum associated with the minimum output voltage $V_{LOAD_MIN}$, the current has the highest current gain as shown by the current gain curve graph 400A. When the load is at a maximum associated with the maximum output voltage $V_{LOAD_MAX}$, the current has the lowest current gain as shown by the current gain curve graph 400C. When the load is at an intermediate associated with the intermediate output voltage $V_{LOAD_INT}$, the current has an intermediate current gain as show by the current gain curve graph 400B.

The current gain curve graph 400A includes a resonant frequency $f_{res_1}$ and a first operating frequency $f_{op_1}$ corresponding to a maximum load current $I_{LOAD_MAX}$. The current gain graph 400B includes a resonant frequency $f_{res_2}$ and a second operating frequency $f_{op_2}$ corresponding to an intermediate load current $I_{LOAD_INT}$. The current gain curve graph 400C includes a resonant frequency $f_{res_3}$ and a third operating frequency $f_{op_3}$ corresponding to a minimum load current $I_{LOAD_MAX}$. As illustrated, the self-resonant frequency decreases when the load voltage $V_{LOAD}$ decreases.

In the closed loop mode, or the normal operating mode, the resonant circuit 140 operates at a frequency below its self-resonant frequency. The minimum operating frequency $f_{op_min}$ of the driver IC 130 is typically set to be slighter greater than resonant frequency $f_{res_1}$ when the load $R_{LOAD}$ is at a minimum output voltage $V_{LOAD_MIN}$, which is associated with the maximum output current $I_{LOAD_MAX}$, as shown by current gain curve graph 400A. Accordingly, the maximum output current $I_{LOAD_MAX}$ can be clamped by the minimum operating frequency $f_{op_min}$. With regard to the current gain curve graphs 400B, 400C, however, the respective output currents $I_{LOAD}$ at the minimum operating frequency $f_{op_min}$ are less than a target current associated with the maximum output current $I_{LOAD_MAX}$. As a result, if the operating frequency $f_{op}$ of the converter 100 has been pushed to the minimum operating frequency $f_{op_min}$ by the control loop, then the converter 100 will be stuck there (e.g., in the open loop mode) until or unless the reference current $I_{REF}$ is adjusted to be lower than the output current $I_{LOAD}$ at the minimum operating frequency $f_{op_min}$ in order to reset the control loop (e.g., to transition it back into the close loop mode).

For a specific LED load, there might be a 30% voltage difference between cold LEDs ($V_{LOAD_COLD}$) and warm LEDs ($V_{LOAD_NORM}$). As a result, the current gain curve will be different for cold and warm LEDs, as shown in FIG. 5.

Figure 5:
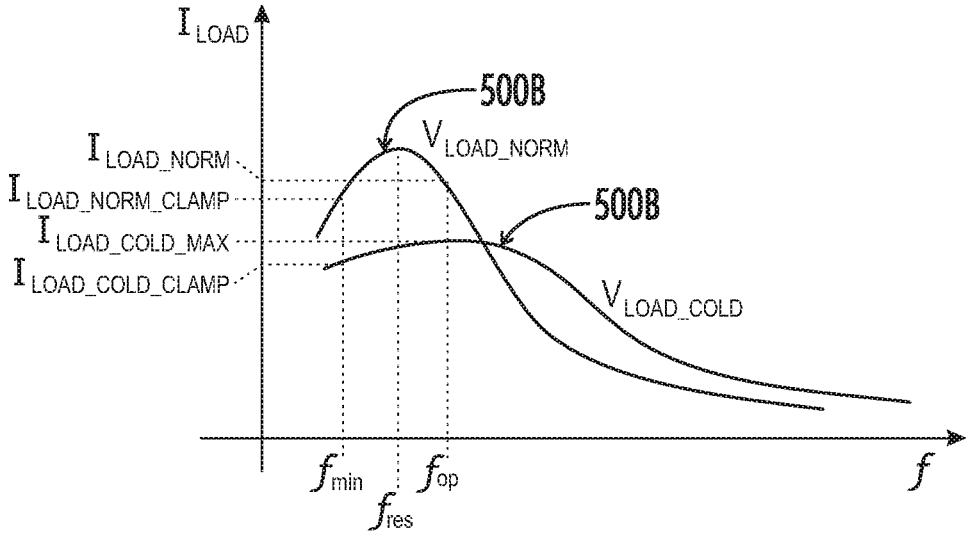
FIG. 5 illustrates a graph of the current gain curves of the output current versus frequency of the half-bridge resonant type DC-DC converter of FIG. 1 for a warm load and for a cold load.

As can best be seen in FIG. 5, a current gain curve graph 500A of the output current $I_{LOAD}$ versus frequency f is shown for the load $R_{LOAD}$ when warm and a current gain curve graph 500B is shown of the output current $I_{LOAD}$ versus frequency f is shown for the load $R_{LOAD}$ when cold. As can be seen in FIG. 5, the normal output current $I_{LOAD_NORM}$ (e.g., in the close loop mode) is higher than the maximum cold output current $I_{LOAD_COLD_MAX}$. Likewise, the normal output clamping current $I_{LOAD_NORM_CLAMP}$ at the minimum frequency $f_{min}$ is higher than the cold output clamping current $I_{LOAD_COLD_CLAMP}$. These variances correspond to the approximately 30% voltage difference between cold LEDs ($V_{LOAD_COLD}$) and warm LEDs ($V_{LOAD_NORM}$).

As can best be seen in FIGS. 6A-6D, the control sequence of the converter 100 associated with starting up the load $R_{LOAD}$ comprising a warm or normal LED load is shown. When the load $R_{LOAD}$ is warm, the output current $I_{LOAD}$ follows the current gain curve graph 500A shown in FIG. 5.

Figure 6A:
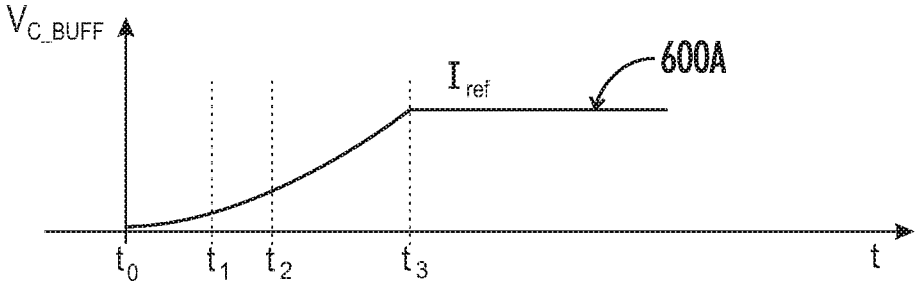
FIG. 6A illustrates a graph of the voltage across the buffer capacitor versus time associated with a startup control sequence of the half-bridge resonant type DC-DC converter of FIG. 1 when the load is warm.
Figure 6B:
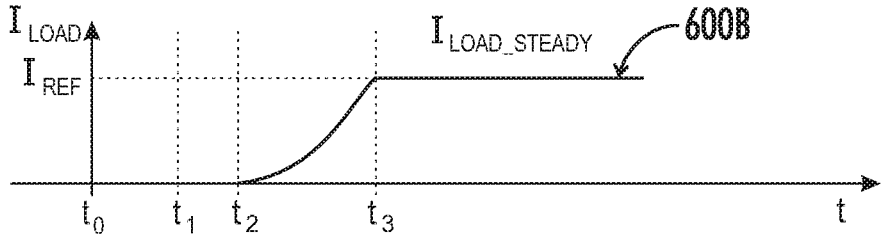
FIG. 6B illustrates a graph of the reference current versus time associated with the startup control sequence of the half-bridge resonant type DC-DC converter of FIG. 1 when the load is warm.
Figure 6C:
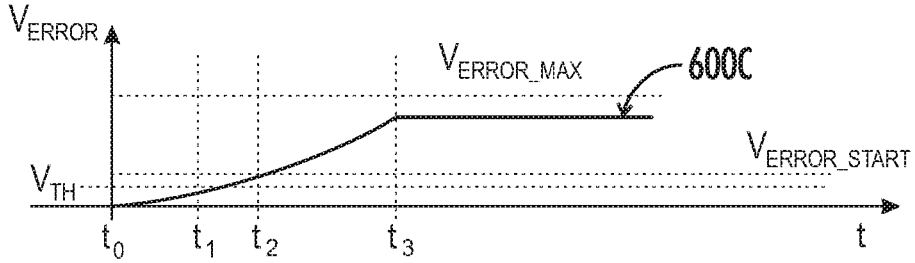
FIG. 6C illustrates a graph of the error signal versus time associated with the startup control sequence of the half-bridge resonant type DC-DC converter of FIG. 1 when the load is warm.
Figure 6D:
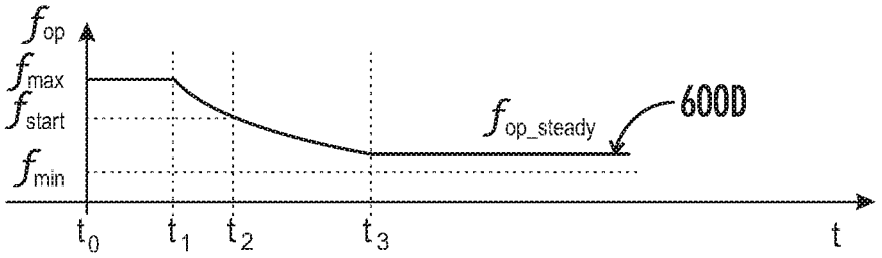
FIG. 6D illustrates a graph of the operating frequency versus time associated with the startup control sequence of the half-bridge resonant type DC-DC converter of FIG. 1 when the load is warm.

When the power is initially turned on, the driver IC 130 operates at the maximum frequency $f_{max}$, shown by the operating frequency waveform 600D between time to and time $t_1$ of FIG. 6D. The reference current input of the OPAMP 172 (e.g., the voltage $V_{C_BUFF}$ across the buffer capacitor $C_{BUFF}$, illustrated by the current control voltage waveform 600A) is charged up slowly by the reference current $I_{REF}$, as shown in FIG. 6A during this time interval. The output current $I_{LOAD}$ through the load $R_{LOAD}$, represented by the output current waveform 600B, is also zero during this time interval because the output voltage is less than the breakdown voltage of the load $R_{LOAD}$ at the maximum operating frequency $f_{max}$, as shown in FIG. 6B.

At time $t_1$, the error signal $V_{ERROR}$, represented by the error signal waveform 600C, increases to the breakdown voltage $V_{TH}$ of the opto-diode in the input stage of the optocoupler 182, as shown in FIG. 6C. At the breakdown voltage $V_{TH}$, the opto-diode begins to conduct current. As a result, the impedance of the phototransistor in output stage of the optocoupler 182 will decrease and cause the operating frequency $f_{op}$ to decrease, as shown in FIG. 6D.

At time $t_2$, the operating frequency $f_{op}$ is a high enough frequency $f_{start}$, associated with a starting error signal $V_{ERROR_START}$, to cause the resonant circuit 140 to output a voltage that breaks down the LEDs of the load $R_{LOAD}$, as shown in FIG. 6D. The LEDs of the load $R_{LOAD}$ start to conduct current $I_{LOAD}$ after time $t_2$, as shown in FIG. 6B.

Since the output current $I_{LOAD}$ is smaller than the voltage $V_{C_BUFF}$ across the buffer capacitor $C_{BUFF}$ between time $t_2$ and time $t_3$, the error signal $V_{ERROR}$ will keep increasing until the output current $I_{LOAD}$ matches the reference current $I_{REF}$ which is associated with a steady state output current $I_{LOAD_STEADY}$, as shown in FIGS. 6A-6C. After time $t_3$, the operating frequency $f_{op}$ will be controlled around $f_{op_steady}$, above the minimum frequency $f_{min}$, and the error signal $V_{ERROR}$ will be below the saturated OPAMP output $V_{ERROR_MAX}$, as shown in FIGS. 6C-6D. The saturated OPAMP output $V_{ERROR_MAX}$ may also be referred to herein as the maximum error signal $V_{ERROR_MAX}$.

As we can see, when the load $R_{LOAD}$ is normal, or warm, the operating frequency $f_{op}$ will not be pushed over the hump of the current gain curve graph 500A. In other words, the operating frequency $f_{op}$ is always greater than the self-resonant frequency $f_{res}$ and close-loop negative feedback control through the feedback circuit 170 works well (i.e., the converter 100 is maintained in the close loop mode).

However, when the load $R_{LOAD}$ is cold, the current gain curve graph 500B is different, as shown in FIG. 5. The current gain curve graph 500B for the cold LED load has less gain than the current gain curve graph 500A for the warm LED load. This means that when the LED load is cold, the resonant circuit 140 will never be able to drive the target output current $I_{LOAD}$ into the load $R_{LOAD}$ (e.g., LEDs).

As can best be seen in FIGS. 7A-7D, the control sequence of the converter 100 associated with starting up the load $R_{LOAD}$ comprising a cold LED load is shown. When the load $R_{LOAD}$ is warm, the output current $I_{LOAD}$ follows the current gain curve graph 500A shown in FIG. 5.

Figure 7A:
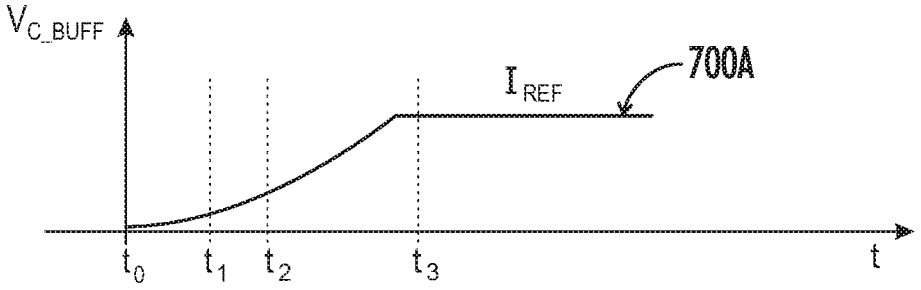
FIG. 7A illustrates a graph of the voltage across the buffer capacitor versus time associated with a startup control sequence of the half-bridge resonant type DC-DC converter of FIG. 1 when the load is cold.

Just as for a load $R_{LOAD}$ comprising warm LEDs, when the load $R_{LOAD}$ comprises cold LEDs, the reference current input of the OPAMP 172 (e.g., the voltage $V_{C_BUFF}$ across the buffer capacitor $C_{BUFF}$, represented by the current control voltage waveform 700A) is charged up slowly by the reference current $I_{REF}$, as shown in FIG. 7A.

Figure 7B:
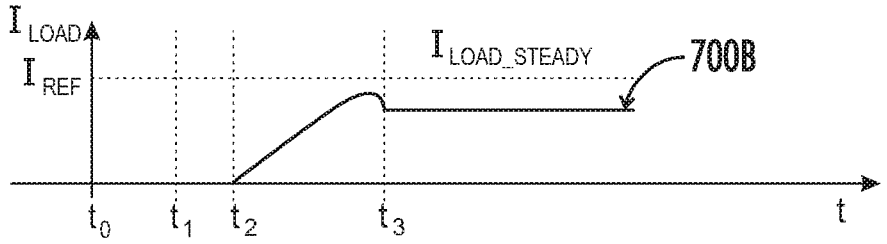
FIG. 7B illustrates a graph of the reference current versus time associated with the startup control sequence of the half-bridge resonant type DC-DC converter of FIG. 1 when the load is cold.
Figure 7C:
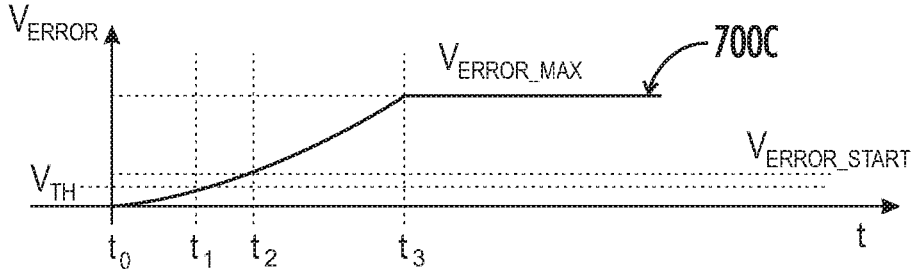
FIG. 7C illustrates a graph of the error signal versus time associated with the startup control sequence of the half-bridge resonant type DC-DC converter of FIG. 1 when the load is cold.
Figure 7D:
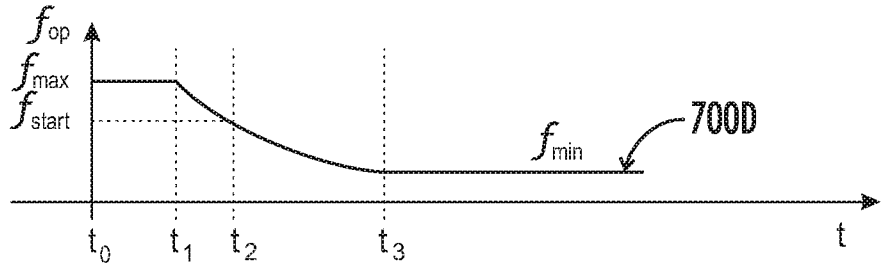
FIG. 7D illustrates a graph of the operating frequency versus time associated with the startup control sequence of the half-bridge resonant type DC-DC converter of FIG. 1 when the load is cold.

When the load $R_{LOAD}$ comprises cold LEDs, the error signal $V_{ERROR}$, shown in FIG. 7C and represented by the error signal waveform 700C, will keep pushing the operating frequency $f_{op}$ down, shown in FIG. 7D and represented by the operating frequency waveform 700D, in order to increase the output current $I_{LOAD}$, shown in FIG. 7B and represented by the output current waveform 700B. However, due to the limited gain of the current gain curve graph 500B in FIG. 5 for a cold LED load, the output current $I_{LOAD}$ will never reach the reference current $I_{REF}$. As a result, the error signal $V_{ERROR}$ will keep increasing until it reaches the maximum error signal $V_{ERROR_MAX}$ of the OPAMP 172, associated with the saturated voltage thereof, shown in FIG. 7C.

When the error signal is at a maximum $V_{ERROR_MAX}$, the opto-diode in the input stage of the optocoupler 182 conducts enough current to saturate the emitter of the phototransistor in output stage of the optocoupler 182, which causes the voltage across the second maximum frequency resistor $R_{MAX2}$ of the frequency control block 190 of the current control circuit 180 to be greater than the reference voltage $V_{REF}$ at the timing terminal $R_T$ of the driver IC 130. Since the voltage across the second maximum frequency resistor $R_{MAX2}$ is greater than the reference voltage $V_{REF}$, the first diode $D_1$ of the frequency control block 190 of the current control circuit 180 stops conducting current. As a result, the only component that connects to the timing terminal $R_T$ is the minimum frequency resistor $R_{MIN}$. As a result, the operating frequency $f_{op}$ of the driver IC 130 will be set at the minimum frequency $f_{min}$.

The error signal $V_{ERROR}$ will be maintained at the maximum error signal $V_{ERROR_MAX}$ so long as the output current $I_{LOAD}$ is less than the reference current $I_{REF}$.

When the LEDs comprising the load $R_{LOAD}$ warm up, the current gain curve shifts to the current gain curve graph 500A, shown in FIG. 5, associated with the warm LED load. The issue, however, is that at the minimum frequency $f_{min}$, the associated output current $I_{LOAD_NORM_CLAMP}$ would still be less than the target, or reference, current $I_{REF}$ or $I_{LOAD_NORM}$. As a result, the error signal $V_{ERROR}$ will be high at the maximum error signal $V_{ERROR_MAX}$, and effectively the resonant circuit 140 will be working in the open loop mode fixed at the minimum frequency $f_{min}$.

As discussed above, in the open loop mode, the output current $I_{LOAD}$ will have a big ripple whose peak could be greater than the maximum rated current of the LEDs of the load $R_{LOAD}$. This may cause LED over current damage. Accordingly, it is very desirable to be able to automatically recover, or get back into the close loop mode, when the converter 100 gets stuck in the open loop mode.

Figure 8:
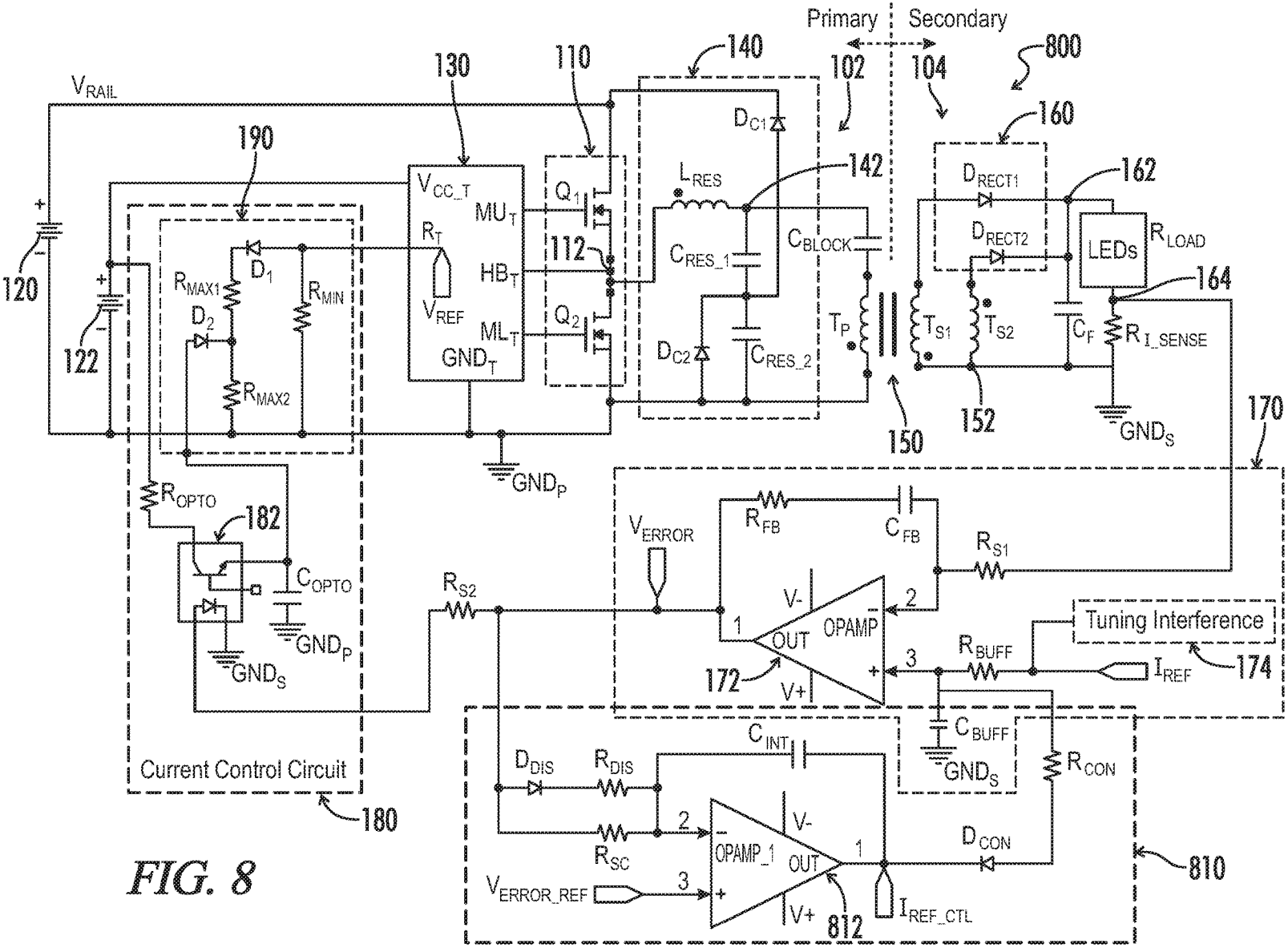
FIG. 8 illustrates an improved half-bridge resonant type DC-DC converter with a current reference control circuit for regaining negative feedback control when the converter enters an overload condition.

To solve this problem, a current reference control circuit 810 is added to the original converter 100 of FIG. 1, as shown in FIG. 8, to define an improved half-bridge resonant type DC-DC converter 800. Similar elements of the converter 800, shown in FIG. 8, are numbered similar to those of the converter 100, shown in FIG. 1. The current reference control circuit 810 is configured to regain close-loop negative feedback control after the resonant circuit 140 of the converter 800 gets stuck at the minimum frequency $f_{min}$.

The current reference control circuit 810 includes a current control operational amplifier (OPAMP) 812 having an inverting (−) input terminal, having a non-inverting (+) input terminal, and having an output (OUT) on an output terminal. The current control OPAMP 812 is used to control the error signal $V_{ERROR}$ from the feedback circuit 170. A reference error signal $V_{ERROR_REF}$ is connected to the non-inverting input terminal of the current control OPAMP 812 and is the setpoint for the current control OPAMP 812 to start protecting.

The current reference control circuit 812 includes an integrator capacitor $C_{INT}$ connected between the inverting input terminal and the output terminal. The current reference control circuit 812 further includes two branches connected between the inverting input terminal of the current control OPAMP 812 and the output terminal of the OMAMP 172 of the feedback circuit 170. The first branch includes a discharge diode $D_{DIS}$ in series with a discharge resistor $R_{DIS}$ to provide a quick discharge path for the integrator capacitor $C_{INT}$ when the error signal $V_{ERROR}$ is greater than the reference error signal $V_{ERROR_REF}$. The second branch includes a slow charge resistor $R_{SC}$, which is designed to have a very larger resistance, for providing a very slow charge path to the integrator capacitor when the error signal $V_{ERROR}$ is less than the reference error signal $V_{ERROR_REF}$.

The current reference control circuit 812 further includes a control diode $D_{CON}$ and a control resistor $R_{CON}$ connected in series between the output terminal of the current control OPAMP 812 and the and the non-inverting input terminal of the OPAMP 172 of the feedback circuit 170. The control diode $D_{CON}$ and the control resistor $R_{CON}$ are used to control the voltage across the buffer capacitor $C_{BUFF}$ of the feedback circuit 170. The output terminal of the current control OPAMP 812 generates a reference control output signal $I_{REF_CTL}$.

During operation, when the reference control output signal $I_{REF_CTL}$ of the current control OPAMP 812 is higher than the reference current $I_{REF}$, then the control diode $D_{CON}$ doesn't conduct and the control resistor $R_{CON}$ is effectively out of the circuit. When the reference control output signal $I_{REF_CTL}$ of the current control OPAMP 812 is lower than the reference current $I_{REF}$, then the voltage $V_{C_BUFF}$ across the buffer capacitor $C_{BUFF}$ is controlled by the output of the current control OPAMP 812.

As can best be seen in FIGS. 9A-9E, the control sequence of the converter 800 associated with starting up the load $R_{LOAD}$ comprising a cold LED load is shown. As mentioned above, when the LEDs of the load $R_{LOAD}$ are cold, the voltage could be much higher than for normal or warm LEDs. For cold LEDs, the output current $I_{LOAD}$ follows the current gain curve graph 500B shown in FIG. 5.

The cold LED current gain curve, shown in FIG. 5, does not have enough current gain and as such the resonant circuit will never be able to drive the target current, otherwise known as the reference current $I_{REF}$. As a result, after startup at time $t_2$ the error signal $V_{ERROR}$, represent by the error signal waveform 900C, will keep increasing to the set-point, otherwise known as the reference error signal $V_{ERROR_REF}$, at time $t_3$, shown in FIG. 9C. The operating frequency $f_{op}$, represented by the operating frequency waveform 900D, produced by the driver IC 130 will be pushed down to the minimum frequency $f_{min}$ between time $t_1$ and time $t_3$, shown in FIG. 9D. Likewise, the output current $I_{LOAD}$, represented by the output current waveform 900B, will increase to the cold output clamping current $I_{LOAD_COLD_CLAMP}$ between time $t_2$ and time $t_3$, as shown in FIG. 9B. Furthermore, between time $t_1$ and time $t_3$, the reference control output signal $I_{REF_CTL}$, represented by the reference control waveform 900E, of the current control OPAMP 812 is higher that the reference signal $I_{REF}$. For example, the reference control output signal $I_{REF_CTL}$ is equal to $I_{REF_CTL_MAX}$ which is greater than $I_{REF}$ during that interval in order to allow the feedback circuit 170 to attempt to start up normally.

Figure 9A:
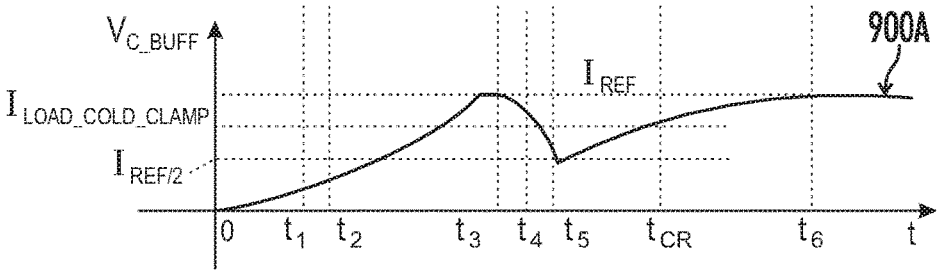
FIG. 9A illustrates a graph of the voltage across a buffer capacitor of the feedback circuit versus time associated with a startup control sequence of the improved half-bridge resonant type DC-DC converter of FIG. 8 when the load is cold.
Figure 9B:
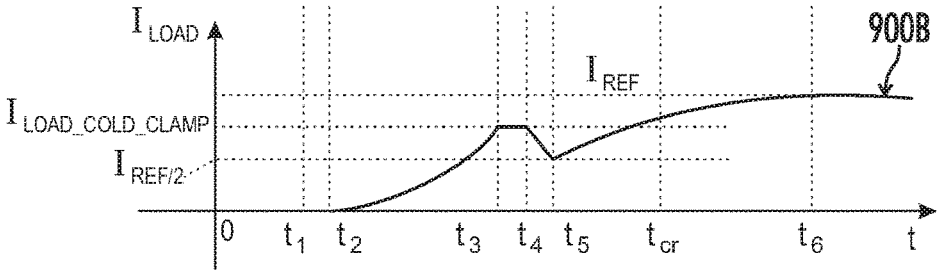
FIG. 9B illustrates a graph of a reference current of the feedback circuit versus time associated with the startup control sequence of the improved half-bridge resonant type DC-DC converter of FIG. 8 when the load is cold.
Figure 9C:
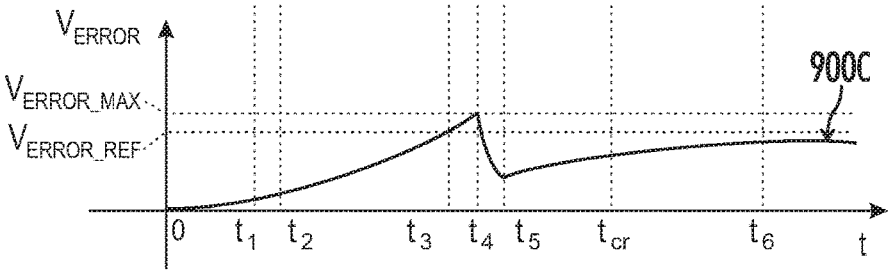
FIG. 9C illustrates a graph of an error signal of the feedback circuit versus time associated with the startup control sequence of the improved half-bridge resonant type DC-DC converter of FIG. 8 when the load is cold.

Between time $t_3$ and time $t_4$, the error signal $V_{ERROR}$ will continue to increase to the maximum error signal $V_{ERROR_MAX}$ since the output current $I_{LOAD}$ is less than the reference signal $I_{REF}$ during that period of time, as shown in FIGS. 9B and 9C. The reference control output signal $I_{REF_CTL}$ at the output of the current control OPAMP 812 will decrease fast during this time interval due to the error signal $V_{ERROR}$ being greater than the reference error signal $V_{ERROR_REF}$ and due to the fast discharging path of the integrator capacitor $C_{INT}$ through the discharge resistor $R_{DIS}$ and discharge diode $D_{DIS}$. The decrease of the reference control output signal $I_{REF_CTL}$ will pull down the voltage $V_{C_BUFF}$ across the buffer capacitor $C_{BUFF}$ through the control diode $D_{CON}$ and the control resistor $R_{CON}$, shown in FIGS. 9A and 9E.

At time $t_4$, the voltage $V_{C_BUFF}$ across the buffer capacitor $C_{BUFF}$, represented by the current control voltage waveform 900A, decreases to the cold output clamping current $I_{LOAD_COLD_CLAMP}$ which is the same as the real output current $I_{LOAD}$, shown in FIG. 9A.

Figure 9D:
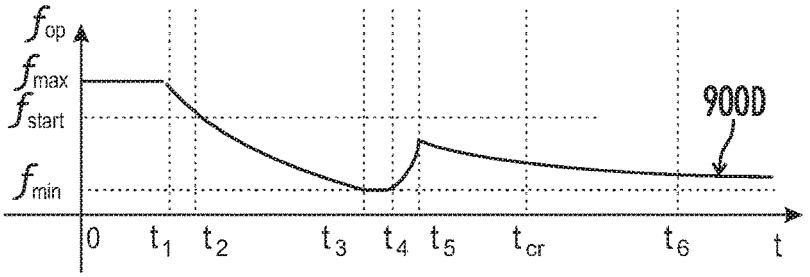
FIG. 9D illustrates a graph of an operating frequency of the improved half-bridge resonant type DC-DC converter of FIG. 8 versus time associated with the startup control sequence when the load is cold.

Right after time $t_4$, the voltage $V_{C_BUFF}$ across the buffer capacitor $C_{BUFF}$ will continue to be pulled down to be smaller than the cold output clamping current $I_{LOAD_COLD_CLAMP}$, which is smaller than the real output current $I_{LOAD}$, shown in FIG. 9A. As a result, the feedback circuit 170 will force the error signal $V_{ERROR}$ at the output of the OPAMP 172 to decrease fast, as shown in FIG. 9C. The decrease of the error signal $V_{ERROR}$ will cause the operating frequency $f_{op}$ of the driver IC 130 to increase and the output current $I_{LOAD}$ to decrease, as shown in FIGS. 9B and 9D.

Figure 9E:
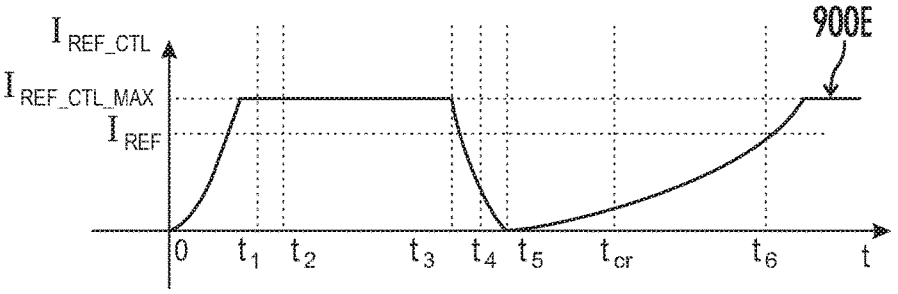
FIG. 9E illustrates a graph of a reference control output signal of the current reference control circuit versus time associated with the startup control sequence of the improved half-bridge resonant type DC-DC converter of FIG. 8 when the load is cold.

At time $t_5$, the reference control output signal $I_{REF_CTL}$ reaches zero, as shown in FIG. 9E. As shown in this embodiment, at time $t_5$, the voltage $V_{C_BUFF}$ across the buffer capacitor $C_{BUFF}$ will be equal to the reference current $I_{REF}$ divided by 2 (e.g., $I_{REF}/2$), shown in FIG. 9A, because the control resistor $R_{CON}$ resistance has been selected or specially design to be equal to that of the buffer capacitor $C_{BUFF}$. In other embodiments, the voltage $V_{C_BUFF}$ across the buffer capacitor $C_{BUFF}$ could be any value lower than the cold output clamping current $I_{LOAD_COLD_CLAMP}$ by adjusting the resistance value of the control resistor $R_{CON}$.

The time interval between time $t_3$ and time $t_5$ could be very small due to the fast discharging path of the integrator capacitor $C_{INT}$ through the discharge resistor $R_{DIS}$ and discharge diode $D_{DIS}$. As the slow charge resistor $R_{SC}$ resistance is very large for charging the integrator capacitor $C_{INT}$, the current control OPAMP 812 will have a delay to its negative input. As shown in FIG. 9C, the error signal $V_{ERROR}$ is smaller than the reference error signal $V_{ERROR}$ REF. As a result, the reference control output signal $I_{REF_CTL}$ will continue to decrease to zero during that time interval, as shown in FIG. 9E.

At time $t_5$, the current reference control circuit 810 reaches its steady state at control current $I_{REF}/2$, as shown in FIG. 9A. The current reference control circuit 810 will then slowly charge up the integrator capacitor $C_{INT}$ through the slow charge resistor $R_{SC}$. As a result, the voltage $V_{C_BUFF}$ across the buffer capacitor $C_{BUFF}$ will slowly increase to that associated with the reference current $I_{REF}$.

If during the time interval between $t_5$ and $t_6$, the LEDs comprising the load $R_{LOAD}$ warm up enough, their voltage will be normal again, rather than cold. The current gain control of the improved converter 800 will switch to the current gain control graph 500A associated with of a warm or normal LED load, shown in FIG. 5. The ramp up process will be just like that of starting up a warm or normal load, shown in FIGS. 6A-6D, which means that the feedback circuit 170 will raise the error signal $V_{ERROR}$ (shown in FIG. 9C), the operating frequency $f_{op}$ will decrease (shown in FIG. 9D), and the output current $I_{LOAD}$ will gradually increase (shown in FIG. 9B) to the final set-point (e.g., the reference current $I_{REF}$), when the reference control output signal $I_{REF_CTL}$ reaches the reference current $I_{REF}$ at time $t_6$, shown in FIG. 9E.

The charging of the integrator capacitor $C_{INT}$ is designed to be very slow so that it takes a very long time for the reference control output signal $I_{REF_CTL}$ of the current control OPAMP 812 to reach the reference current $I_{REF}$. Typically, during the time period from $t_5$ to $t_6$, the LED of the load $R_{LOAD}$ will warm up enough to transition to operation in the normal voltage range in accordance with the current gain control graph 500A of FIG. 5.

If the LEDs comprising the load $R_{LOAD}$ are still cold at time $t_{er}$, the time at which the voltage $V_{C_BUFF}$ across the buffer capacitor $C_{BUFF}$ reaches the cold output clamping current $I_{LOAD_COLD_CLAMP}$, then the feedback circuit 170 will lose control again after time $t_{er}$. As a result, the control sequence during the time interval between $t_3$ and $t_5$, shown in FIGS. 9A-9E, will repeat until the LEDs comprising the load $R_{LOAD}$ are warm enough to transition to operation in the normal voltage range in accordance with the current gain control graph 500A of FIG. 5. The current reference control circuit 810 will continue to attempt to reestablish feedback control of the feedback circuit 170 by repeatedly sweeping the reference current $I_{REF}$ between $I_{REF}$ and $I_{REF}/2$.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A power converter, comprising:

first and second switching elements coupled across a direct current (DC) power source;

a resonant circuit coupled between an isolation transformer primary winding and an output node between the first and second switching elements;

a current sensing circuit coupled between an output load and a secondary winding of the isolation transformer, and configured to provide a sensor output signal representative of an output current through the load;

a feedback circuit configured to generate an error signal corresponding to a difference between the sensor output signal and a reference signal;

a controller comprising a frequency control input terminal, and configured to generate drive signals to the first and second switching elements at a determined operating frequency;

a frequency control circuit coupled between the feedback circuit and the frequency control input terminal of the controller, and configured, responsive to the error signal, to determine the operating frequency of the controller with respect to defined minimum and maximum frequencies; and a current reference control circuit configured to control the error signal of the feedback circuit when the error signal is greater than a reference error signal of the current reference control circuit, wherein the current reference control circuit includes a slow charge path and a quick discharge path in parallel between the output terminal of the feedback circuit and an integrator capacitor of the current reference control circuit, wherein the quick discharge path is configured to discharge the integrator capacitor at a first rate when the error signal is greater than the reference error signal, and wherein the slow charge path is configured to charge the integrator capacitor at a second rate slower than the first rate when the error signal is less than the reference error signal.

2. The power converter of claim 1, wherein:

the slow charge path includes a first resistor having a first resistance; and the quick discharge path includes a diode in series with a second resistor having a second resistance smaller than the first resistance.

3. The resonant power converter of claim 1, wherein:

the integrator capacitor is coupled between an inverting input terminal of an operational amplifier and an output terminal of the operational amplifier; and the slow charge path and the quick discharge path are coupled to the inverting input terminal of the operational amplifier.

4. The resonant power converter of claim 3, wherein:

the feedback circuit includes a buffer resistor coupled between the reference signal and the first input terminal, and a buffer capacitor coupled between the first input terminal and a secondary side ground reference; and the current reference control circuit includes an output control diode coupled in series with an output control resistor between the output terminal of the operational amplifier and the first input terminal of the feedback circuit.

5. The resonant power converter of claim 4, wherein:

the operational amplifier is configured to generate a reference control signal at the output terminal; and a voltage across the buffer capacitor is controlled by the reference control signal when the reference control signal is lower than the reference signal.

6. The resonant power converter of claim 5, wherein:

the voltage across the buffer capacitor is controlled by the reference signal when the reference control signal is greater than the reference signal.

7. The power converter of claim 6, wherein:

the output control diode is reverse biased when the reference control signal is greater than the reference signal.

8. The power converter of claim 1, wherein:

the reference error signal is received at a non-inverting input terminal of an operational amplifier of the current reference control circuit.

9. A method to regain negative feedback control from an overload condition in a resonant power converter, the method comprising:

(a) regulating a switch operating frequency of the resonant power converter to provide output power to an LED load;

(b) generating an error signal corresponding to a difference between the provided output power and a reference value;

(c) generating a reference control signal based at least in part on the error signal; and (d) automatically controlling the reference value when the reference value is greater than the generated reference control signal.

10. The method of claim 9, wherein step (d) further comprises:

reducing the error signal based on the generated reference control signal.

11. The method of claim 9, wherein step (d) further comprises:

reducing the generated reference control signal below the reference signal when the sensed error signal is greater than a reference error signal of the current reference control circuit; and slowly increasing the generated reference control signal when the sensed error signal is less than the reference error signal of the current reference control circuit.

12. The method of claim 11, further comprising:

repeating each step until the LED load transitions from a cold operational state to a normal operational state.

13. The method of claim 9, further comprising:

operating the LED load in a cold operational state associated with a maximum cold LED current being less than a maximum normal LED current associated with the LED load in a normal operational state, the cold operational state further associated with the sensed error signal being greater than a reference error signal of the current reference control circuit; and repeating steps (b) through (d) until the LED load operates in the normal operational state.

14. An LED driver comprising:

a DC-DC converter comprising a plurality of switching elements configured to produce an output voltage across first and second output terminals and an output current through an LED load coupled thereto, based on a DC input and an operating frequency;

a current sensor coupled in series with the LED load;

a control means for regulating the operating frequency based on an error signal derived at least in part from output signals from the current sensor relative to a reference value; and a reference control means for controlling the error signal in response to the error signal exceeding a reference error signal for regaining negative feedback control of the control means, wherein the reference control means includes:

a quick discharge means for quickly reducing the error signal in response to the error signal exceeding the reference error signal; and a slow charge means slowly increasing the error signal in response the error signal being reduced.

15. The LED driver of claim 14, wherein:

wherein the reference control means manipulates the reference value in order to temporarily affect the error signal.

16. The LED driver of claim 14, wherein:

the slow charge means gives the LED load time to warm up in order to transition from a cold operational state to a normal operational state.

17. A power converter, comprising:

first and second switching elements coupled across a direct current (DC) power source;

a resonant circuit coupled between an isolation transformer primary winding and an output node between the first and second switching elements;

a current sensing circuit coupled between an output load and a secondary winding of the isolation transformer, and configured to provide a sensor output signal representative of an output current through the load;

a feedback circuit configured to generate an error signal corresponding to a difference between the sensor output signal and a reference signal;

a controller comprising a frequency control input terminal, and configured to generate drive signals to the first and second switching elements at a determined operating frequency;

a frequency control circuit coupled between the feedback circuit and the frequency control input terminal of the controller, and configured, responsive to the error signal, to determine the operating frequency of the controller with respect to defined minimum and maximum frequencies;

a current reference control circuit configured to control the error signal of the feedback circuit when the error signal is greater than a reference error signal of the current reference control circuit;

wherein the feedback circuit includes a buffer resistor coupled between the reference signal and the first input terminal, and a buffer capacitor coupled between the first input terminal and a secondary side ground reference; and wherein the current reference control circuit is configured to control a voltage across the buffer capacitor when a reference control signal generated by the current reference control circuit is less than the reference signal.

18. The power converter of claim 17, wherein:

the reference error signal is received at a non-inverting input terminal of an operational amplifier of the current reference control circuit.

* * * * *